US008327766B2

(12) United States Patent
Twarog, Jr. et al.

(10) Patent No.: US 8,327,766 B2
(45) Date of Patent: Dec. 11, 2012

(54) ENERGETIC LINEAR TIMING ELEMENT

(75) Inventors: Joseph W. Twarog, Jr., Barkhamsted, CT (US); John C. Campbell, Jr., East Hartford, CT (US); Tyson J. Plitt, Barkhamsted, CT (US); Kim Chi Ho, Plainville, CT (US)

(73) Assignee: Dyno Nobel Inc., Salt Lake City, UT (US)

( * ) Notice: Subject to any disclaimer, the term of this patent is extended or adjusted under 35 U.S.C. 154(b) by 1586 days.

(21) Appl. No.: 10/553,932

(22) PCT Filed: Apr. 30, 2004

(86) PCT No.: PCT/US2004/013340

§ 371 (c)(1),
(2), (4) Date: Mar. 8, 2007

(87) PCT Pub. No.: WO2005/005911

PCT Pub. Date: Jan. 20, 2005

(65) Prior Publication Data

US 2007/0272107 A1 Nov. 29, 2007

(51) Int. Cl.
*C06C 5/00* (2006.01)
*C06C 5/06* (2006.01)

(52) U.S. Cl. ..... 102/275.1; 102/275.11; 102/275.8; 102/276

(58) Field of Classification Search ..... 102/275.8, 102/275.1, 275.3, 275.6, 275.9, 275.11, 276
See application file for complete search history.

(56) References Cited

U.S. PATENT DOCUMENTS

| | | | |
|---|---|---|---|
| 1,964,390 | A | 6/1934 | Stuart |
| 2,416,639 | A | 2/1947 | Pearsall |
| 2,963,971 | A | 12/1960 | Home |
| 3,027,839 | A | 4/1962 | Grandy et al. |
| 3,590,739 | A | 7/1971 | Persson |
| 3,730,096 | A | 5/1973 | Prior |
| 4,220,087 | A | 9/1980 | Posson |
| 4,244,900 | A | 1/1981 | Heider |
| 4,288,262 | A | 9/1981 | Flanagan et al. |
| 4,290,366 | A | 9/1981 | Janoski |
| 4,328,753 | A | 5/1982 | Kristensen et al. |

(Continued)

FOREIGN PATENT DOCUMENTS

WO WO 01/08937 A1 2/2001

OTHER PUBLICATIONS

Sartomer Product Bulletin: SR-238, 1,6 Hexanediol Diacrylate, 2027 R. 12/98.

(Continued)

*Primary Examiner* — James Bergin
(74) *Attorney, Agent, or Firm* — Cantor Colburn LLP

(57) ABSTRACT

A timing element for an initiator is made from a reactive polymeric material such as, e.g., a glycidyl azide polymer. The reactive polymeric material may include pulverulent oxidizer additives, such as ammonium, perchlorate and/or ferric oxide. The oxidizer additives are used to increase the rate of reaction and the output spark of the polymer material. The timing element serves to delay the travel of an initiation signal between an input, such as a signal transmission input line, and an explosive output charge, for a predetermined period of time, usually about 5 to about 10,000 milliseconds, e.g., about 9 to about 9600 milliseconds.

27 Claims, 2 Drawing Sheets

U.S. PATENT DOCUMENTS

| | | | | |
|---|---|---|---|---|
| 4,402,270 | A | 9/1983 | McCaffrey | |
| 4,493,261 | A | 1/1985 | Simon et al. | |
| 4,607,573 | A | 8/1986 | Thureson et al. | |
| 4,660,474 | A | 4/1987 | Dias dos Santos | |
| H000272 | H * | 5/1987 | Gilbert | 525/328.8 |
| 4,699,059 | A | 10/1987 | Kelly et al. | |
| 4,756,250 | A | 7/1988 | Dias dos Santos | |
| 4,757,764 | A | 7/1988 | Thureson et al. | |
| 4,817,673 | A | 4/1989 | Zoghby et al. | |
| 4,838,165 | A | 6/1989 | Gladden et al. | |
| 4,841,856 | A | 6/1989 | Gisler et al. | |
| 5,001,981 | A | 3/1991 | Shaw | |
| 5,009,163 | A | 4/1991 | Robins et al. | |
| 5,010,821 | A | 4/1991 | Blain | |
| 5,048,420 | A | 9/1991 | Beck et al. | |
| 5,101,729 | A | 4/1992 | Noble et al. | |
| 5,166,470 | A | 11/1992 | Stewart | |
| 5,208,419 | A | 5/1993 | Greenhorn et al. | |
| 5,212,341 | A | 5/1993 | Osborne et al. | |
| 5,243,913 | A | 9/1993 | Brent et al. | |
| 5,316,600 | A | 5/1994 | Chan et al. | |
| 5,317,974 | A | 6/1994 | Stewart et al. | |
| 5,351,618 | A | 10/1994 | Brent et al. | |
| 5,383,405 | A | 1/1995 | Everest | |
| 5,431,100 | A | 7/1995 | Snyder | |
| 5,435,249 | A | 7/1995 | Brent et al. | |
| 5,473,987 | A | 12/1995 | Beck | |
| 5,507,891 | A | 4/1996 | Zeigler | |
| 5,509,355 | A | 4/1996 | Stewart et al. | |
| 5,518,807 | A | 5/1996 | Chan et al. | |
| 5,597,973 | A | 1/1997 | Gladden et al. | |
| 5,616,883 | A | 4/1997 | Hamilton et al. | |
| 5,625,162 | A | 4/1997 | Appleby | |
| 5,629,493 | A | 5/1997 | Andersson et al. | |
| 5,681,904 | A | 10/1997 | Manzara | |
| 5,827,994 | A | 10/1998 | Gladden et al. | |
| 5,837,924 | A | 11/1998 | Austin | |
| 5,844,322 | A | 12/1998 | Andersson et al. | |
| 5,945,627 | A | 8/1999 | Arpin et al. | |
| 6,006,671 | A | 12/1999 | Yunan | |
| 6,062,143 | A * | 5/2000 | Grace et al. | 102/530 |
| 6,170,398 | B1 | 1/2001 | Rabotinsky et al. | |
| 6,298,784 | B1 | 10/2001 | Knowlton et al. | |
| 6,347,566 | B1 | 2/2002 | Rabotinsky et al. | |
| 6,539,869 | B2 | 4/2003 | Knowlton et al. | |
| 6,886,469 | B2 * | 5/2005 | Shilliday et al. | 102/530 |
| 8,061,273 | B2 * | 11/2011 | Bayliss et al. | 102/275.1 |
| 2002/0035945 | A1 | 3/2002 | Knowlton et al. | |
| 2007/0272107 | A1 * | 11/2007 | Twarog et al. | 102/275.1 |

OTHER PUBLICATIONS

Anthony P. Manzara, 3M Specialty Chemicals Division, "A New Cure System for Azido Polymers", Approved for public release Apr. 1996, 8 pages.

http://www.chemicalland21.com/arokorhi/specialtychem/perchem/N-BUTYRYL%20CHL . . . , Apr. 15, 2004, N-Butyryl Chloride (Butanoyl Chloride), "n-Butyryl Chloride", 2 pages.

http://search.chemexper.com/__KFPNKUMHFTNBQNKQNQNMPOLQOE__?for=ccd&sea . . . Apr. 15, 2004, Poly(vinyl butyral), 1 page.

Rob Hunter and Tony Manzara, 3M Performance Materials,"Interaction of Glycidyl Azide Polymer Plasticizer With Other Polymers", 8 pages, facsimile-transmitted Apr. 26, 2002.

3M Industrial Products Division, technical data Glycidyl Azide Polymer Polyol L-I2369 (Experimental), issued Dec. 1991, 2 pages.

3M Industrial Products Division, technical data Glycidyl Azide Polymer Polyol L-12616 (Experimental), issued Apr. 1992, 2 pages.

International Search Report for PCT/US2004/13340, international filing date of Apr. 30, 2004, mailed Nov. 7, 2007, 3 pages.

International Preliminary Report on Patentability for PCT/US2004/013340, international filing date of Apr. 30, 2004, mailed Nov. 29, 2007, 5 pages.

Written Opinion for PCT/US2004/13340, international filing date of Apr. 30, 2004, mailed Nov. 7, 2007, 3 pages.

* cited by examiner

ENERGETIC LINEAR TIMING ELEMENT

BACKGROUND OF THE INVENTION

1. Field of the Invention

The present invention relates to a timing element, in particular, to an energetic linear timing element, such as timing elements used in an initiator, such as a detonator or other explosive initiating device, for delaying initiation of the explosive output charge in the initiator.

2. Related Art

A timing element (also known as a fuse) is typically located within an initiator and is interposed between a signal transmission input line and an output charge, thereby connecting the input line and the output charge in initiation signal communication. Timing elements are used to delay the travel of an initiation signal between the signal transmission input line and the detonator output charge for a predetermined period of time (the "delay interval" or "burn time") that may range from 9 milliseconds ("ms") to 900 ms, typically, 350 ms to 500 ms. Conventional timing elements include "drawn" timing elements and "rigid" timing elements, both of which comprise a pulverulent delay composition disposed within a metal sheath. The pulverulent delay composition may comprise pyrotechnic material comprising any one or more of the following mixtures of fuels and oxidizers: silicon and lead dioxide ($PbO_2$); silicon and red lead oxide ($Pb_3O_4$); silicon, red lead oxide ($Pb_3O_4$) and antimony trisulfide ($Sb_2S_3$); tungsten, potassium perchlorate ($KClO_4$) and barium chromate ($BaCrO_4$); molybdenum and potassium perchlorate ($KClO_4$); and others, and mixtures thereof. In a conventional drawn timing element, the sheath comprises a material such as lead, pewter, aluminum or other suitable ductile metal that may readily be deformed by pressure or crimping. Typically, a hollow tube of a soft, malleable metal such as lead or pewter is filled with a pyrotechnic material, and the filled tube is then passed through a series of reducing dies to decrease the diameter of the sheath and compress the pyrotechnic material. The burn rate of the timing element is dependent upon the composition and resulting density of the pyrotechnic material, and on the length of the timing element. In a rigid timing elements, the sheath comprises a hard, non-malleable metal of fixed length, e.g., steel or zinc, loaded with pyrotechnic material and, possibly, an organic binder. The loaded material is pressed to a fixed height and density to provide a selected burn time.

An initiator comprises a shell into which an output charge (or base charge) is deposited. The output charge provides the output signal of the initiator. The output charge is generally pressed into the shell, and then other components, optionally including a timing element, are pressed into the shell over the base charge. An initiating means, i.e., an input signal line (detonating cord, fuse cord, shock tube, etc.), is then secured to the shell with a seal to prevent contaminants from entering the shell. Pressing is performed with a pin, the end of which may be crowned, pointed or slightly tapered. Initiators include detonators, which provide explosive output signals and pyrotechnic initiators, which provide pyrotechnic output signals.

A "signal transmission tube" is a hollow plastic (polymer) tube having a reactive material on the interior surface thereof and being suitable for use in transmitting a detonation signal through the tube by ignition of the reactive material. The defined term embraces shock tubes of the type disclosed in U.S. Pat. Nos. 4,328,753 and 4,607,573, which have a coating of pulverulent high brisance explosive material such as PETN (pentaerythrite tetranitrate), RDX (cyclotrimethylenetrinitramine) (also known as Cyclonite or Hexogen), HMX (cyclotetrame-thylenetetranitramine) (Homocyclonite or Octogen) or TNT (2,4,6-trinitrotoluene) on the interior wall of the tube, and low velocity signal transmission tubes of the type disclosed in U.S. Pat. No. 5,257,764, which have deflagrating material on the interior surface of the tube. Deflagrating materials include silicon/red lead ($Si/Pb_3O_4$), molybdenum/potassium perchlorate ($Mo/KClO_4$), tungsten/potassium perchlorate ($W/KClO_4$), titanium hydride/potassium perchlorate ($TiH_2/KClO_4$) and zirconium/ferric oxide ($Zr/Fe_2O_3$). Other suitable deflagrating compositions are boron/red lead ($B/Pb_3O_4$), titanium/potassium perchlorate ($Ti/KClO_4$), zirconium/potassium perchlorate ($Zr/KClO_4$), aluminum/potassium perchlorate ($Al/KClO_4$), zirconium hydride/potassium perchlorate ($ZrH_2/KClO_4$), manganese/potassium perchlorate ($Mn/KClO_4$), and the like. In both kinds of signal transmission tubes, the tube may be formed from an extruded synthetic polymeric material such as EAA (ethylene/acrylic acid copolymer), EVA (ethylene vinyl acetate) or a SURLYN™ such as SURLYN™ 8940, an ionomer resin available from E. I. DuPont de Nemours Company, low density polyethylene (LDPE), linear low or medium density polyethylene, linear low, medium and high density polyester and polyvinylidene chloride (PVC), and suitable blends or polymer alloys of such materials.

U.S. Pat. No. 5,681,904 issued Oct. 28, 1997 to Anthony P. Manzara discloses a polymer material comprising a glycidyl azide polymer, either as a plasticizer or a polyol, cross-linked with a multifunctional acrylate (column 2, line 9 through line 14 and column 3, line 34 through line 41) or polyisocyanate. The hardness and burning properties of the polymer material are determined by the particular multifunctional acrylate, and amount thereof, which is cross-linked with the glycidyl azide polymer (column 8, line 44 through line 65). The polymer material may be used in a wide variety of applications, e.g., as a high energy material, as a binder in an explosive material or a rocket propellant, or with a gas-generating material used in an air bag apparatus (column 2, line 16 through line 24).

SUMMARY OF THE INVENTION

A timing element comprises a delay composition in a sheath, wherein the delay composition comprises a reactive polymeric material. According to one aspect of the invention, the delay composition may comprise a GAP material, such as a cross-linked GAP acrylic material or a cross-linked GAP urethane material. Optionally, the delay composition may further comprise a pulverulent oxidizer material. The oxidizer material may comprise about 0.25% to about 10% of the delay composition, by weight.

In another aspect, the delay composition may comprise a pulverulent fuel, in an amount of about 0.25 to about 2%, by weight.

In particular embodiments, the sheath may comprise polyacrylonitrile, polybutadiene, polystyrene, ABS copolymer, polyphenylene oxide, polysulfone, cellulose acetate butyrate, or a modified ethylene acrylate polymeric material, or a combination comprising any of the foregoing.

A method for making a timing element comprises disposing a curable reactive material precursor in a sleeve, and then cross-linking the curable reactive material precursor resin to form a reactive polymeric material in the sleeve. Optionally, the sleeve comprises a polymeric material, the method comprising injecting curable reactive material precursor resin into a sleeve under pressure sufficient to expand the diameter of the sleeve by about 0.4% to about 1.2%.

The curable reactive material precursor resin may comprise at least about 20% DPEHA by weight, e.g., about 20% to about 40%; in a particular embodiment, about 29% by weight.

An initiator comprises a shell having a closed end and an opening for a signal transmission fuse, an output charge in the closed end of the shell, a signal transmission fuse secured in the opening, and a timing element in the shell situated to be initiated by the fuse and to initiate the output charge, wherein the timing element comprises a reactive polymeric material. Optionally, the timing element may comprise a reactive polymeric material in a sheath.

A method for making a delay initiator comprises disposing an output charge in an initiator shell, depositing a curable reactive material precursor resin into the initiator shell, cross-linking the curable reactive material precursor resin in the shell and securing an initiation means in the shell in initiating relationship with the delay composition. The initiation means may comprise a signal transmission tube such as shock tube, or an electrical initiation element. A method for making a delay initiator comprises disposing an output charge in an initiator shell, cooling a timing element comprising a cross-linked reactive polymeric material to a size that facilitates insertion of the timing element into the shell, inserting the cooled timing element into the shell, securing a fuse line in the shell in initiating relationship with the timing element, and permitting the timing element to warm to ambient temperature so that it expands to engage the interior surface of the shell.

DETAILED DESCRIPTION OF THE INVENTION AND PREFERRED EMBODIMENTS THEREOF

Figure 1:
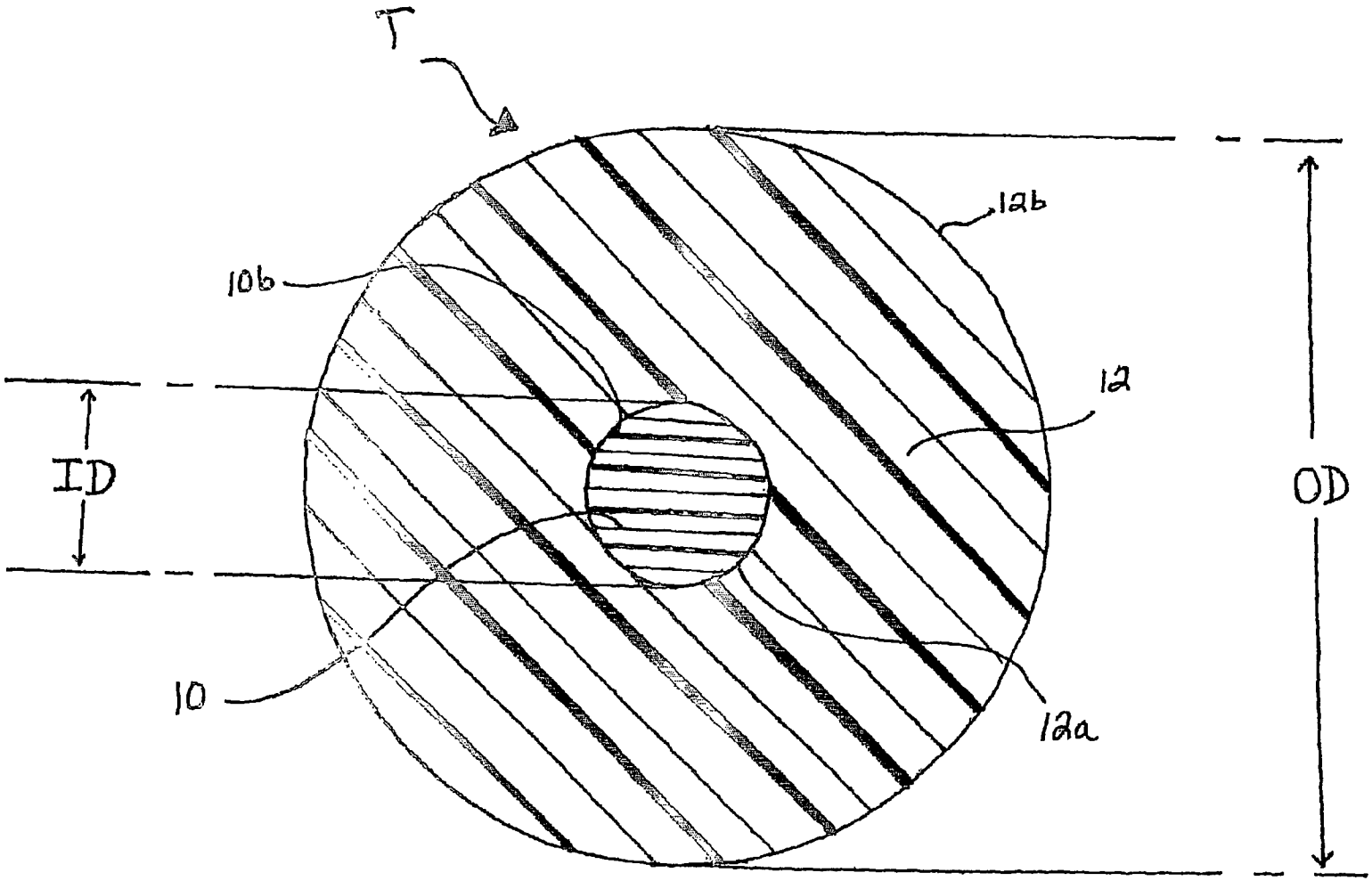
FIG. 1 is a cross-sectional view of one embodiment of a timing element in accordance with the present invention.

A timing element for an initiator described herein comprises a delay composition comprising a reactive polymeric material. Reactive polymeric materials are cross-linked polymeric materials that have reactive pendant groups such as azido groups, nitrate groups, triazoline groups and/or triazole groups chemically bonded to the polymer backbone, rather than comprising a relatively inert polymeric material or resin having pulverulent reactive material physically blended therein. However, a reactive polymeric material may optionally have one or more pulverulent reactive materials physically blended therein, such as an oxidizer additives, e.g., ammonium perchlorate and/or ferric oxide. Oxidizer additives are used to increase the rate of reaction and the output spark of the polymer material. The timing element serves to delay the travel of an initiation signal between an input, such as a signal transmission input line, and an explosive output charge, for a predetermined period of time, usually about 5 to about 10,000 milliseconds, e.g., about 9 to about 9600 milliseconds.

Some reactive polymeric materials may be obtained from a curable reactive material precursor resin by cross-linking resinous (e.g., liquid) azido polymers such as a glycidyl azido polymer (GAP) resin, which is, as described in U.S. Pat. No. 5,681,904 (which is hereby incorporated herein by reference), commercially available in polyol form (having hydroxyl functional end groups) or as a plasticizer (non-hydroxylated resin). GAP resins have pendant azido groups and may be cross-linked to form reactive polylmeric materials (referred to herein as "GAP materials") for use in a timing element.

GAP resins are commercially available as 40% solutions in solvents such as ethyl acetate or xylene, from which the solvent may be removed by evaporation. Non-cross-linking additives, such as fuel and/or an oxidizer, as described below, may be added. The resin is then degassed and then chilled, e.g., to as low as −35° C., for storage. The cross-linking agent is added shortly before final processing, because the resin may cure quickly once the cross-linking agent is added even under ambient conditions. Once the cross-linking agent is added, the resin may again be degassed and cooled. It may then be injected into a jacket using a cold high pressure injector, or into an initiator shell, or it may be extruded and cured into a rod, as described further herein.

The GAP polyol resin may be cross-linked with a cross-linking agent comprising, e.g., a polyisocyanate, to react with the hydroxyl end groups, yielding a cross-linked GAP urethane material having pendant azido groups. Alternatively, GAP resins (either polyol or plasticizer) may be cross-linked with a cross-linking agent comprising multi-functional dipolarophile molecules such as acrylic esters, acrylic amides, acetylenic esters, acetylenic amides, and/or mixtures thereof, which react with the azido groups (and which therefore do not require the polyol resin form) to form cross-linked GAP acrylic material having pendant triazoline groups and/or triazole groups. The cross-linking agent may be used in amounts of about 10 to about 100 parts per hundred (pph) parts of the resin (by weight). Two example cross-linking agents of this kind are pentaerythritol triacrylate (PETA) and/or dipentaerythritol hexaacrylate (DPEHA). The cross-linking agent DPEHA should be used in an amount of at least about 20% by weight of the GAP resin, to ensure reliable ignition under ambient pressure conditions, preferably about 29%, for maximum burn rate. Cross-linking occurs under relatively mild conditions, e.g., at ambient temperatures. Cross-linking may be initiated or controlled by radiation techniques, e.g., UV radiation, electron beam radiation, X-ray, etc.

Such reactive polymeric materials have been found to be sensitive to initiation by the signal emitted by a signal transmission line, e.g., shock tube. Thus, a GAP material may be described as "shock-tube-sensitive", i.e., sensitive to initiation by shock tube. Accordingly, timing elements comprising reactive polymeric materials may be used with initiators secured on signal transmission lines comprising shock tube or low velocity signal line. Such materials are themselves capable of initiating an output charge of an initiator. These materials are also less susceptible to deactivation by foreign contaminants such as moisture relative to pulverulent chemical delay compositions, making the sealing of the initiator less crucial. Some such materials, e.g., GAP material, are non-toxic and do not produce toxic mineral residue when they function.

Reactive polymeric materials such as GAP material burn significantly more uniformly than pulverulent chemical delay compositions. Therefore, timing elements comprising these reactive polymeric materials can be manufactured with greater accuracy and uniformity of burn time than other chemical timing elements, and they can be formulated to provide a wide range of burn rates, although burn rate appears to be more temperature sensitive than the burn rate of pulverulent timing compositions and sensitive to changes in pressure in the initiator resulting from the release of gaseous combustion products.

One way of controlling the effect of pressure changes on burn rate of a reactive polymeric material is to dispose the timing element in a closed system, i.e., in a device in which the gas expansion volume is fixed. For example, a timing element in an initiator mounted on one end of a signal tube releases gas into the tube, but if the other end of the tube is open, the timing element is part of an open system (i.e., open to the release of reaction product gases) and the burn rate may vary with the length of the tube and the nature of the open orifice. However, if the end of the tube opposite from the timing element (i.e., the input end of the tube) is sealed and the tube remains substantially intact, the sealed tube constitutes a "closed" pressure system and the burn rate of a timing element therein comprising a reactive polymeric material has been found to vary much less with the length of the tube than in an open system. The burn rate of GAP material in closed systems also appears to be less temperature sensitive than an open system. There are various ways to initiate a signal in a closed system, including the use of a percussive initiating fixture secured on the input end of the tube. In some embodiments, a signal donor squib or detonator situated against the side of the tube at a position between the ends will initiate a signal in the tube without leaving the tube "open", i.e., with open secured ends from which gas can easily escape.

Alternatively, an open system may be designed to release gases in a predetermined fashion, to provide a predictable burn time. In some uses it may therefore be advisable to provide an initiator or the shock tube with a gas discharge vent when using these timing elements.

GAP material is also able to generate an output that is capable of initiating a standard output charge in an initiator, e.g., a GAP material is sufficiently brisant to initiate a base charge of a detonator.

Reactive polymeric material may be formed into a timing element in various ways. A curable precursor resin may extruded, cured and shaped into segments sized for insertion in an initiator; the resin may be injected into the initiator and cured therein, or the resin may be injected into a sheath and cured therein, and the sheathed material may then be cut into timing elements of desired length, as described herein.

Optionally, GAP material or other reactive polymeric material may contain pulverulent reactive materials that were blended into the GAP resin, including fuels and/or oxidizers. Fuels include powdered metals such as titanium, zirconium, tungsten, silicon, magnesium, manganese, iron, etc., which may be present in amounts of about 0.25 to about 2% by weight of the GAP resin. Oxidizers include ferric oxide, ammonium perchlorate, potassium perchlorate, etc., which may be present in amounts of about 0.25 to about 10% by weight of the GAP resin. In a particular embodiment, a GAP material may contain 1% fuel metal, e.g., titanium, and about 1% of an oxidizer, e.g., ammonium perchlorate, by weight of the GAP material. Such loading of fuel (especially titanium) and/or oxidizer may accelerate the burn rate and increase the brisance of the GAP material. In addition, the oxidizer may scavenge and oxidize any hydrogen cyanide that might be produced when the GAP material reacts.

In another aspect of the present invention, the curable reactive material precursor resin is extruded into a rod and while being extruded, or soon thereafter, is cured so that it retains its shape and achieves a desired burning characteristic and a size suitable for use in an initiator shell. The resultant continuous or lengthy rod has a diameter corresponding to the interior of the initiator shell or jacket in which it will be used, e.g., it may have a diameter of about 0.0625 inch (0.16 cm) to about 0.26 inch (about 0.7 cm). In one embodiment, the rod may have a diameter of 0.260 inch. The rod is then cut into segments to produce timing elements of a desired length for a selected burn time. Such rod segments of reactive polymeric material may have a length of about 0.25 inch (0.635 cm) to about 4 inches (about 10 cm), optionally about 0.25 inch (0.635 cm) to about 1.5 inch (about 3.8 cm). In one embodiment, a segment may be about 0.25 inch (about 0.635 cm) long. A segment of the rod is then inserted into the shell of an initiator containing an output charge therein.

Optionally, the rod segments may be sized so that, at ambient temperature, when fully cross-linked, it is slightly compressed by the interior surface of the initiator shell. Such a configuration is advantageous because the timing element will then be held in place by pressure and friction on the interior surface of the shell, and it may form a seal with the shell that may protect the output charge therein. To facilitate the insertion of the timing element into the shell, the timing element may be cooled, e.g., by immersion in liquid nitrogen, so that it contracts to a size in which it is easily insertable into the shell. The timing element is then allowed to reach thermal equilibrium with the environment and, in so doing, expands to engage the interior surface of the initiator shell. Alternatively, the initiator shell may be tapered, to permit easy insertion of the timing element therein.

In one embodiment of the present invention, the timing element comprises the reactive polymeric material encased within a sheath or outer jacket to provide a jacketed timing element. In one embodiment, the outer jacket may comprise a polymeric material such as polyethylene. Preferably, the outer jacket comprises a material to which the reactive polymeric material will adhere. Such materials include polyacrylonitrile, polybutadiene, polystyrene, ABS copolymer, polyphenylene oxide, polysulfone, cellulose acetate butyrate, and material sold by I.E. Du Pont de Nemours and Co. under the trade designation Bynel® 2200, a modified ethylene acrylate polymeric material, individually or in combination with each other or with other materials. The jacket has an outer surface and an inner surface, the inner surface defining a bore that extends through the outer jacket. The inside diameter of the outer jacket may range from about 0.045 inch to 0.200 inch (about 0.114 to 0.508 cm), e.g., 0.0625 inch (0.1588 cm). Optionally, the interior surface of the jacket may be physically configured to improve the adhesion of the jacket to the reactive polymeric material. The jacketed reactive polymeric material may be readily cut to form individual jacketed timing elements of desired lengths. The outside diameter of the outer jacket is selected to conform to the initiator for which the timing element will be utilized. In a particular embodiment, the outside diameter of the jacket will be about 0.260 inch (about 0.66 cm), the inside diameter of a standard detonator.

In one embodiment, chilled, degassed, uncured reactive polymeric resin is injected into a tube comprising the outer jacket material under pressure sufficient to cause the jacket to expand slightly before cross-linking is complete. The tube may be formed from, i.e., may comprise, a polymeric material such as polyethylene, or a polymeric material to which the reactive polylmeric material therein will better adhere. The resin may be injected into a length of tube that is initially open-ended. When the tube is full, the open end may be crimped closed, and continued injection at a pressure of about 1200 to about 1500 psi causes the tube to expand so that its diameter increases by about 0.4 to about 1.2 percent, e.g., by about 0.8%. For example, a 0.260 inch (0.66 cm) OD tube may expand to as much as about 0.263 inch (about 0.67 cm). The resin may then be cured, e.g., by heating the filled tubes at 50° C. for two hours. As the resin shrinks upon cross-linking, the outer jacket shrinks to the originally planned size. The filled tube may then be cut into lengths that yield timing elements having selected burn times. Each timing element may then be incorporated into an initiator in the same manner as any other timing element, being pressed in place with a flat-ended pin rather than a tapered pin.

Alternatively, uncured reactive material precursor resin may be extruded directly into the shell of an explosive initiating device and cross-linked therein to form a solid reactive polymeric material. The outside diameter of the polymer material is defined by approximately the inside diameter of the explosive initiating device. For example, as a standard detonator has an inside diameter of about 0.260 inch (about 0.66 cm), the timing element will have an outside diameter of about 0.260 inch (about 0.66 cm). After the reactive polymeric material is deposited into the shell, the signal transmission fuse may then be secured in the shell.

Optionally, the shell may be crimped onto the timing element to secure the timing element in place and to provide a seal for the shell. This seal may serve to prevent the contamination of the base charge by the introduction of contaminants or moisture into the shell, at least until the initiator is fully assembled.

After the timing element is disposed in the shell, an initiation means such as the end of a signal transmission fuse (i.e., shock tube, or the like) or an electrical initiation element such as an exploding bridgewire, SCB, etc., may be inserted into the shell and secured therein, e.g., by means of crimping, such that the initiation means is positioned to initiate the timing element.

Referring now to FIG. 1, there is shown in cross section a jacketed (i.e., sheathed) timing element T comprised of a solid core 10 of reactive polymeric material encased within an outer jacket 12. Core 10, having an outer surface 10*b*, comprises a reactive polymeric material preferably comprised of a GAP resin cross-linked with a multifunctional acrylate. Any other suitable reactive polymeric material may be utilized. The reactive polymeric material may further comprise ferric oxide and/or ammonium perchlorate or other suitable oxidizers and propellants. Outer jacket 12 has an inner surface 12*a* and an outer surface 12*b*. The inside diameter ID of outer jacket 12 typically may range from 0.045 inch to 0.200 inch, but is preferably 0.07 inch. Generally, the outside diameter OD of outer jacket 12 is approximately equal to the inside diameter of an explosive initiation device for which it will be utilized, and therefore may be of any suitable size. Core 10 and outer jacket 12 are sandwiched together, that is, inner surface 12*a* of outer jacket 12 is in full contact with outer surface 10*b* of core 10. Optionally, the jacketed timing element may be cooled to facilitate its insertion into the shell of an initiator, as described above.

Figure 2:
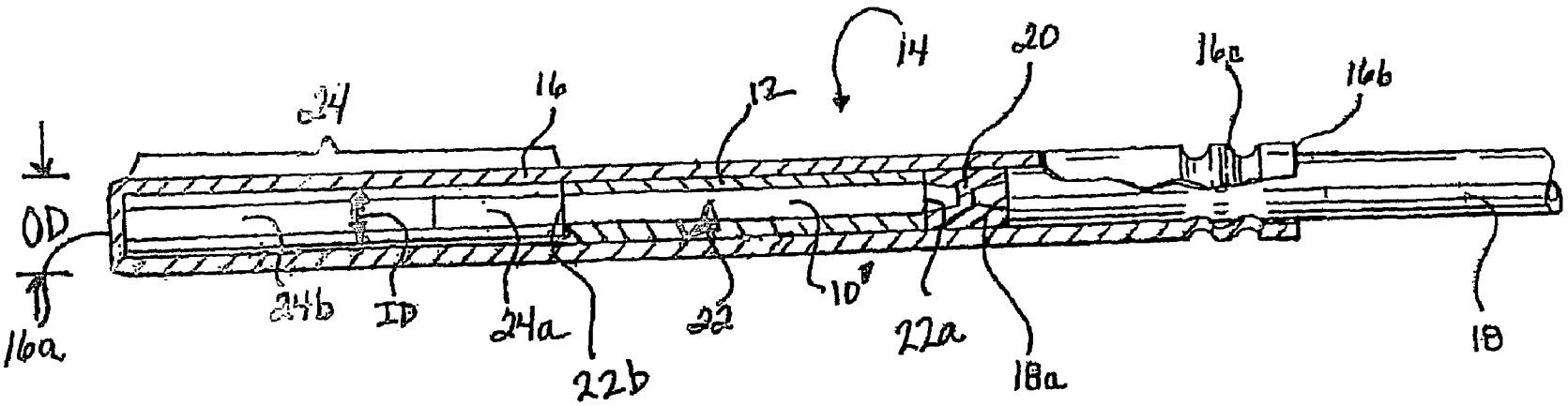
FIG. 2 is a schematic, cross-sectional side view of a detonator containing a timing element in accordance with the present invention.

Referring now to FIG. 2, there is shown a detonator 14 comprised of a conventional cylindrical metal shell 16 of substantially constant outside diameter OD and a substantially constant inside diameter ID. Shell 16 is of a circular cross section and has a closed end 16*a* and an opposite, open end 16*b*. Open end 16*b* is secured at crimp 16*c* to an initiation signal line, which in the illustrated embodiment, comprises a shock tube 18. Shock tube 18 terminates within shell 16 at end 18*a* thereof and abuts an isolation member 20 which provides a stand-off between the end 18*a* of shock tube 18 and the reactive materials contained in shell 16. As is well known, isolation member 20 serves to inhibit the transfer of static electricity from shock tube 18 to the reactive or explosive materials within shell 16.

Detonator 14 further comprises an energetic linear timing element 22 having an input end 22*a* and an output end 22*b* and interposed between isolation member 20 and explosive output charge 24. Timing element 22 comprises a reactive polymeric material 10' encased within an outer jacket 12', as illustrated with respect to timing element T of FIG. 1. Timing element 22 is of a composition and length that provides a predetermined time lapse between emission of the signal from end 18*a* of shock tube 18 and initiation of explosive output charge 24. The rate of reaction of timing element 22 may be about 35 milliseconds per inch (ms/in) to about 1,000 ms/in (about 13.8 milliseconds per centimeter (ms/cm) to about 394 ms/cm).

Explosive output charge 24 comprises a top or primary charge 24*a* and a base charge 24*b*. Primary charge 24*a* typically comprises a small quantity of a primary explosive material (e.g., lead azide, diazodinitrophenol, hexanitromannite, lead styphnate, etc.) that is sensitive to the signal it receives from the timing element 22, which signal was initiated in response to the signal emitted from end 18*a* of shock tube 18. As is well known in the art, shock tube 18 may be initiated by any suitable means, such as a spark generated at the end of shock tube 18 opposite from end 18*a*, or by a detonator or low-energy detonating cord utilized to initiate the signal in shock tube 18 from externally thereof. The signal from end 18*a* of shock tube 18 ignites reactive polymeric material 10' at input end 22*a* of timing element 22 and when the reaction emerges from output end 22*b* it initiates primary charge 24*a* and secondary charge 24*b*.

Base charge 24*b* typically comprises one or more secondary explosive materials (e.g., PETN, RDX, HMX, etc.). When initiated by shock tube 18, primary charge 24*a* releases sufficient energy to initiate base charge 24*b*. The primary charge 24*a* may be omitted if the base charge 24*b* is sufficiently sensitive to the signal initiated by shock tube 18. Such a base charge 24*b* may comprise one or more primary explosive materials or a combination of primary and secondary explosive materials.

The dimensions and composition of reactive material 10' determine the delay, normally measured in milliseconds, e.g., 9 to 9,600 milliseconds, between the signal emerging from end 18*a* of shock tube 18 and initiation of explosive output charge 24 by the signal emerging from output end 22*b* of timing element 22.

While the invention has been described with reference to specific embodiments thereof, it will be appreciated that numerous other variations may be made to the illustrated specific embodiment which variations nonetheless lie within the spirit and the scope of the invention and the appended claims.

What is claimed is:

1. A timing element comprising a delay composition wherein the delay composition comprises a solid core of cross-linked reactive polymeric material containing a fuel component and an oxidizer component, both components being dispersed within the solid core of the reactive polymeric material, the reactive polymeric material being enclosed in a sheath.

2. A timing element comprising a delay composition wherein the delay composition comprises a solid core of cross-linked reactive polymeric material enclosed in a sheath.

3. The timing element of claim 2 wherein the reactive polymeric material comprises a GAP material.

4. The timing element of claim 3 wherein the reactive polymeric material comprises a cross-linked GAP acrylic material.

5. The timing element of claim 3 wherein the reactive polymeric material comprises a cross-linked GAP urethane material.

6. The timing element of claim 3 further comprising an oxidizer component dispersed within the solid core of the reactive polymeric material and present therein as a pulverulent oxidizer material.

7. The timing element of claim 6 wherein the oxidizer component comprises about 0.25% to about 10% of the delay composition, by weight.

8. The timing element of claim 3 or claim 6 further comprising a fuel component dispersed within the solid core of the reactive polymeric material and present therein as a pulverulent fuel.

9. The timing element of claim 8 wherein the pulverulent fuel component comprises about 0.25% to about 2% of the delay composition, by weight.

10. The timing element of claim 8 wherein the fuel component is present in an amount of about 1% of the delay composition, by weight.

11. The timing element of claim 2 or claim 3 wherein the sheath comprises one or more of polyacrylonitrile, polybutadiene, polystyrene, ABS copolymer, polyphenylene oxide, polysulfone, cellulose acetate butyrate, and modified ethylene acrylate polymeric material.

12. A method for making a timing element, the method comprising disposing a curable precursor resin of a reactive polymeric material in a sheath, and then cross-linking the curable precursor resin to form a solid core of cross-linked reactive polymeric material in the sheath.

13. The method of claim 12 wherein the sheath comprises a polymeric material, the method comprising injecting the curable precursor resin into a sleeve under pressure sufficient to expand the diameter of the sheath by about 0.4% to about 1.2%.

14. The method of claim 12 wherein the curable precursor resin comprises a GAP resin and a cross-linking agent.

15. The method of claim 14 wherein an oxidizer component is present in the resin as a pulverulent oxidizing material.

16. The method of claim 15 wherein the oxidizer component is present in an amount of about 0.25% to about 10% of the cross-linked reactive polymeric material, by weight.

17. The method of claim 14 or claim 15 wherein a fuel component is present in the resin as a pulverulent fuel component.

18. The method of claim 17 wherein the fuel component is present in an amount of about 0.25 to about 2% of the cross-linked reactive polymeric material, by weight.

19. The method of claim 12 wherein the curable precursor resin comprises at least about 20% DPEHA.

20. The method of claim 19 wherein the curable precursor resin comprises from about 20% to about 40% DPEHA.

21. The method of claim 20 wherein the curable precursor resin comprises at least about 29% DPEHA.

22. In an initiator comprising:

a shell having a closed end and an opening for a signal transmission tube;

an output charge in the closed end of the shell;

a signal transmission fuse secured in the opening; and a timing element in the shell situated to be initiated by the fuse and to initiate the output charge, the improvement comprising that the timing element comprises a solid core of cross-linked reactive polymeric material.

23. The initiator of claim 22 wherein the solid core of reactive polymeric material is encased in a sheath.

24. The initiator of claim 22 or claim 23 wherein the reactive polymeric material comprises a GAP material.

25. The initiator of claim 22 wherein the improvement further comprises that the solid core of reactive polymeric material contains a fuel component dispersed within the reactive polymeric material.

26. The initiator of claim 22 wherein the improvement further comprises that the solid core of reactive polymeric material contains an oxidizer component dispersed within the reactive polymeric material.

27. The initiator of claim 22 wherein the improvement further comprises that the solid core of reactive polymeric material contains dispersed therewithin a fuel component and an oxidizer component, and the oxidizer component and the fuel component are each present as respective pulverulent materials, the oxidizer component comprising about0.25% to about 10% of the reactive polymeric material, by weight, and the fuel component comprising about 0.25 to about 2% of the reactive polymeric material, by weight.

* * * * *